US007799186B2

(12) United States Patent
Uchiumi

(10) Patent No.: US 7,799,186 B2
(45) Date of Patent: Sep. 21, 2010

(54) PLATING APPARATUS

(75) Inventor: Yuji Uchiumi, Hiratsuka (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 1155 days.

(21) Appl. No.: 11/439,753

(22) Filed: May 24, 2006

(65) Prior Publication Data

US 2007/0114127 A1 May 24, 2007

(30) Foreign Application Priority Data

Nov. 22, 2005 (JP) ..... P2005-336916
Feb. 2, 2006 (JP) ..... P2006-025673

(51) Int. Cl.
*C25D 17/02* (2006.01)
*C25D 7/12* (2006.01)

(52) U.S. Cl. ..... 204/263; 204/275.1

(58) Field of Classification Search ..... None
See application file for complete search history.

(56) References Cited

U.S. PATENT DOCUMENTS 6,126,798 A * 10/2000 Reid et al. ..... 205/143
6,332,963 B1 12/2001 Sakaki et al. ..... 204/266
6,503,376 B2 * 1/2003 Toyoda et al. ..... 204/252
6,527,920 B1 * 3/2003 Mayer et al. ..... 204/252
6,569,299 B1 * 5/2003 Reid et al. ..... 204/282
6,890,416 B1 * 5/2005 Mayer et al. ..... 205/261
6,964,792 B1 * 11/2005 Mayer et al. ..... 427/430.1

FOREIGN PATENT DOCUMENTS

JP 11-350185 12/1999

* cited by examiner

*Primary Examiner*—Harry D Wilkins, III
(74) *Attorney, Agent, or Firm*—Roberts & Roberts, LLP

(57) ABSTRACT

The present invention provides a technology for enabling a diaphragm to be arranged in a more facilitated manner in a plating tank of a plating apparatus having a diaphragm for separating an object to be plated from an anode. The plating apparatus having a plating tank, which plating tank comprising: an opening on which an object to be plated is placed; a solution-supply tube for supplying a plating solution toward the object to be plated; an anode positioned opposed to the object to be plated; and a diaphragm for separating the object to be plated from the anode, wherein an inner wall of the plating tank is provided with a diaphragm-periphery fixing part for fixing a peripheral end of the diaphragm, the solution-supply tube is composed of a dual tube consisting of an inner tube and an outer tube, the inner tube has an inner tube part allowed to pass through a through-hole formed at a center of the diaphragm and a diaphragm through-hole fixing part for fixing the through-hole, and the outer tube has an engaging part for fixing the inner tube with the inner tube part accommodated and further has a tank-fixing part to be fixed in the plating tank.

19 Claims, 8 Drawing Sheets

PLATING APPARATUS

TECHNICAL FIELD

The present invention relates to a plating apparatus, which conducts a plating treatment by using a diaphragm to separate an anode positioned in a plating tank from an object to be plated such as a wafer, a printed-wiring board, and the like.

BACKGROUND ART

Conventionally, various kinds of plating treatments have been conducted on objects to be plated such as a wafer for a semiconductor, a printed-wiring board, and the like. As an apparatus for conducting a plating treatment on such objects to be plated, jet-flow plating apparatuses are known.

A jet-flow plating apparatus is generally provided with: an opening on which an object to be plated can be placed; a solution-supply tube for supplying a plating solution toward the object to be plated; and an anode positioned in an opposed manner to the object to be plated, thereby a plating treatment is carried out while a plating solution is supplied through the solution-supply tube toward the object to be plated. Due to capability of conducting a uniform plating treatment on a surface to be plated of the object to be plated and conducting a plating treatment while objects to be plated that are to be placed on the opening are sequentially replaced, the jet-flow plating apparatuses are now widely used as a preferable one for small lot production and automation of a plating treatment.

Although the jet-flow plating apparatus has the above-described advantages, a film, for instance a black film or the like, to be formed onto a surface of an anode may be broken away into a solution and become impurities to flow in a plating solution supplied toward an objective to be plated, thereby possibly causing a negative effect on a plating treatment. Additionally, air mixed in a solution or bubbles generated from an anode sometimes reach a surface to be plated, thereby inhibiting a good plating treatment. In this jet-flow plating apparatus, therefore, a diaphragm for separating an object to be plated and an anode is arranged within a plating tank (see Patent Document 1: Japanese Patent Application Laid-Open No. 350185/1999).

The jet-flow plating apparatus having a diaphragm arranged within a plating tank as shown in Patent Document 1 resists a negative impact exerted by impurities generated from an anode, prevents wastage of plating additive agent which occurs when an insoluble anode is used, and furthermore surely overcome a negative impact exerted by air bubbles generated from an anode.

DISCLOSURE OF THE INVENTION

However, like the above described prior art document, it is not an easy operation to dispose a diaphragm within a plating tank to assure isolation of an anode from an object to be plated. Especially, when a diaphragm is arranged in a cone-shaped manner in a plating tank as seen in Patent Document 1, such herculean operations were entailed in producing or maintaining an apparatus because a special mounting jig should be prepared for avoiding some inconvenience including wrinkles from generating in the diaphragm, or cone-shaped diaphragms should be arranged in a divided manner.

The present invention was made against a backdrop of the above circumstances, and it is an object of the present invention to provide a technology, which enables a diaphragm to be arranged in a more facilitated manner in a plating tank of a jet-flow type plating apparatus provided with a diaphragm for isolating an object to be plated from an anode.

In order to solve the above problem, the present inventor improved both the plating tank and solution supply tube to reach the present invention, in which a diaphragm can be arranged in the plating tank in a more facilitated manner. The present invention is a plating apparatus having a plating tank, which plating tank comprises: an opening on which an object to be plated is placed; a solution-supply tube for supplying a plating solution toward the object to be plated; an anode positioned opposed to the object to be plated; and a diaphragm for isolating the object to be plated from the anode, wherein an inner wall of the plating tank is provided with a diaphragm-periphery fixing part for fixing a peripheral end of the diaphragm, and the solution-supply tube is composed of a dual tube consisting of an inner tube and an outer tube. The inner tube has an inner tube part allowed to pass through a through-hole formed at a center of the diaphragm and a diaphragm through-hole fixing part for fixing the through-hole, and the outer tube has an engaging part for accommodating and fixing inner tube and further has a tank-fixing part to be fixed in the plating tank.

In the present invention, the diaphragm to be arranged in the plating tank is preliminarily processed the periphery thereof so as to be fixed at an inner tube of the plating tank, and is also formed to have a through hole at a center of the diaphragm, through which the inner tube is passed. Then, the periphery of the diaphragm is fixed on the diaphragm-periphery fixing part provided on the inner wall of the present plating tank. Through the through hole provided at the center of the diaphragm, the inner tube of the solution-supply tube is allowed to pass. An outer tube part of the solution-supply tube of the present invention is separately fixed in the plating tank, an inner tube part passing through the through hole of the diaphragm is inserted into the outer tube, and the entire inner tube is allowed to shift until the inner tube engages with an engaging part of the outer tube part. When the outer tube and the inner tube are engaged with each other to become unified, the periphery of the diaphragm is fixed on the diaphragm-periphery fixing part provided on the inner wall of the present plating tank, and the through hole of the diaphragm is fixed to a diaphragm through-hole fixing part, thereby the diaphragm is arranged in the plating tank. Thus, in the present invention, since the diaphragm is formed with a periphery shaped in conformity with the internal shape of the plating tank and formed with a thorough hole, neither any special mounting jig nor any substantial design change of the apparatus itself is required, thereby a diaphragm can be arranged in a plating tank in an extremely easy manner. Especially, even a diaphragm which is very difficult to handle, for instance one formed by a soft material or small in thickness, the present invention makes it possible to arrange a diaphragm in a plating tank properly without causing damage or wrinkles to the diaphragm.

It is preferable to provide the plating apparatus according to the present invention with a diverging solution flow path formed between the inner wall of the outer tube and the outer wall of the inner tube when the inner tube has been fixed to the outer tube, for supplying a plating solution to the anode chamber, which is formed by separating by use of the diaphragm from the object to be plated. When the interior of the plating tank is separated via the diaphragm into the anode chamber and the cathode chamber where the object to be plated is present, it is necessary to secure a solution supply path for supplying a solution other than a plating solution to be supplied to the object to be plated, in order to exchange the solution present in the anode chamber. In such a case, if the diverging solution flow path for flowing the plating solution to thon the strength e anode chamber is formed on the solution supply tube having a dual tube structure according to the present invention, a part of the plating solution to be supplied will be supplied to the anode chamber side in a facilitated manner by diverging the plating solution to be supplied toward the object to be plated. The structure will eliminate a need to provide extra solution supply tube for supplying a plating solution to the anode chamber side, thereby making the plating apparatus structure itself simple. In this case, it is desirable to provide in the anode chamber a solution discharge path for discharging the plating solution to be supplied to the anode chamber side out of the anode chamber. The solution discharge path can be provided on any area, for example on the inner wall of the plating tank or the bottom of the plating tank so far as the area is within the plating tank. What matters is the plating solution should be supplied into, circulated within, and discharged out of the anode chamber appropriately.

It is also preferable if the diaphragm of the plating apparatus according to the present invention be arranged in the plating tank in a cone-shaped manner. For instance, if the diaphragm is arranged in a cone-shaped manner so that its periphery rises, air bubbles generating from the anode will move along the inclination of the diaphragm toward the periphery thereof, thereby effects of the air bubbles can be circumvented. In order to arrange the diaphragm in a cone-shaped manner, a position, where the diaphragm through hole should be fixed by use of the solution supply tube, only has to be determined lower than a horizontal position of a diaphragm-periphery fixing part provided on the inner wall of the plating tank.

It is further preferable that the plating apparatus according to the present invention is provided beneath the diaphragm-periphery fixing part with an anode-chamber solution discharge port for discharging a plating solution out of the anode chamber, and the anode-chamber solution discharge port is provided with a filter for removing impurities present in the plating solution. In the anode chamber formed by the arrangement of the diaphragm in the plating tank, such impurities for instance black films generating at the anode are highly likely to mix into the solution. If the solution discharged out of the anode chamber should be mixed as it is with the counterpart present in the cathode chamber side, namely the plating solution to be supplied toward the object to be plated, impurities will mix in the entire plating solution, and therefore it is feared a negative effect may be caused on a good plating treatment. In this respect, if the impurities contained in the plating solution discharged out of the anode chamber should be removed by means of the filter, the entire plating solution can be prevented from being contaminated by the impurities.

Further in the plating apparatus according to the present invention, it is preferable if the inner tube has a cap part which covers the periphery of the outer tube, and on a tip of the cap part, there is provided the diaphragm through-hole fixing part. It is also preferable if an upper end of the outer tube be provided with an anode-chamber solution supply port for supplying to the anode chamber the plating solution flowing through the diverging solution flow path, and the anode-chamber solution supply port be provided at a position higher than the horizontal position of the anode-chamber solution discharge port and the diaphragm through-hole fixing part be provided at a position lower than the horizontal position of the anode-chamber solution discharge port.

The interior of the plating tank where the diaphragm has been arranged is to be divided into two chambers consisting of the anode chamber in which an anode exists and the cathode chamber in which the object to be plated has been arranged. When an object to be plated should be replaced after a plating solution has been supplied to each chamber and a plating treatment has been completed, the plating solution is sometimes discharged. When the plating solution in the plating tank has been discharged and the diaphragm emerges from the plating solution and is exposed, the diaphragm itself will be in contact with the air. That is to say, the plating solution level is lower than the position of the diaphragm arranged, the diaphragm will be in contact with the air, which condition will allow air to enter the anode chamber. Under the condition, the diaphragm is likely to deteriorate in an advancing manner, although the deterioration will be dependent on a type or quality of the diaphragm to be used, thereby a wettability of the diaphragm with respect to the plating solution will be deteriorated. Further, if the air enters the anode chamber, an anode used itself will be oxidized if it is a soluble one, and it is feared subsequent plating treatments will be subject to an adverse affect.

Thus, the present inventor studied a structure, which achieves, in replacing objects to be plated in a jet-flow plating apparatus, a condition where the diaphragm is not in contact with the air by positively maintaining the plating solution level higher than the position of the diaphragm placed even after the plating solution in the plating tank is discharged. As a result, it was found that the plating solution level after the plating solution in the plating tank has been discharged should be maintained higher than the position that diaphragm was arranged in the plating tank, namely the diaphragm should be present in the plating solution. Therefore, the apparatus was adapted to have a structure, where the inner tube has a cap part which covers the periphery of the outer tube, and on a tip of the cap part, there is provided the diaphragm through-hole fixing part, the anode-chamber solution supply port provided on the upper end of the outer tube is provided higher than the horizontal position of the anode-chamber solution discharge port, and the diaphragm through-hole fixing part is arranged lower than the horizontal position of the anode-chamber solution discharge port.

In addition, as described above, in adopting a structure for achieving a condition where the diaphragm is not in contact with the air after the plating solution in the plating tank is discharged, it is preferable if a back-flow prevention device is provided so that the plating solution in the anode chamber will not flow out, when the plating solution is discharged, into a diverging solution flow path which is formed between the inner tube and the outer tube in the solution-supply tube having a dual tube structure. With such a back-flow prevention device provided, a condition is securely achievable where a diaphragm is immersed in a plating tank even when the plating solution in a plating tank has been discharged.

Further in addition, in the plating apparatus of the present invention, it is preferable to provide the inner tube with a solution flow diverting means for diverting a plating solution to be supplied toward an object to be plated. In a plating treatment of an object to be plated, it is sometimes severely required a uniformity of a plating thickness, and especially in an alloy plating, a homogeneity of a plating composition. Specifically, depending on the type of a plating solution being used and the conditions of a plating treatment such as an electric current density, the uniformity in both plating thickness and plating composition may sometimes be realized across the plated surface of the object to be plated due to greatly affected by a flowing condition of the plating solution supplied toward the object to be plated. Especially, when the plating solution supplied toward the object to be plated flows in a manner that it spreads from an essential center of the object to be plated to a peripheral direction thereof, the plating thickness in the central area of the object to be plated may sometimes become greater than that of the peripheral area. Further, for instance, when an alloy plating treatment including a Ag—Sn alloy plating is carried out, the alloy plating compositions in the central area and in the peripheral area of the object to be plated are liable to differ from each other. In such a case, it is preferable to provide the inner tube in the plating apparatus of the present invention with a solution flow diverting means for diverting a plating solution to be supplied toward an object to be plated so that the plating solution will not be supplied intensively to a specific area of the object to be plated, thereby conducting a plating treatment providing a uniform plating thickness across the plated surface of the object to be plated and a homogeneous plating composition.

The solution flow diverting means provided in the inner tube is not so limited in terms of its structure insofar as the supplying direction of the plating solution to be supplied from the inner tube toward the object to be plated does not disperse. Specifically, a disk-shaped damper body provided on an upper part in the inner tube at a plating solution supplying side can disperse the flowing condition of the plating solution being supplied, into the plating tank. It is also acceptable to adopt a structure in which a flow-dividing channel is formed within the inner tube in order to disperse the supplying direction of the plating solution into the plating tank.

As described above, the present invention makes it possible to arrange a diaphragm within a plating tank in a very facilitated manner in a plating apparatus having a diaphragm for separating an object to be plated and an anode. The present invention further improves efficiency in a manufacture or maintenance work of a plating apparatus without causing wrinkles in a diaphragm even when the diaphragm is arranged in a cone-shaped manner.

BEST MODE FOR CARRYING OUT THE INVENTION

Preferred embodiments of a plating apparatus related to the present invention are described below with reference to drawings.

First Embodiment

Figure 1:
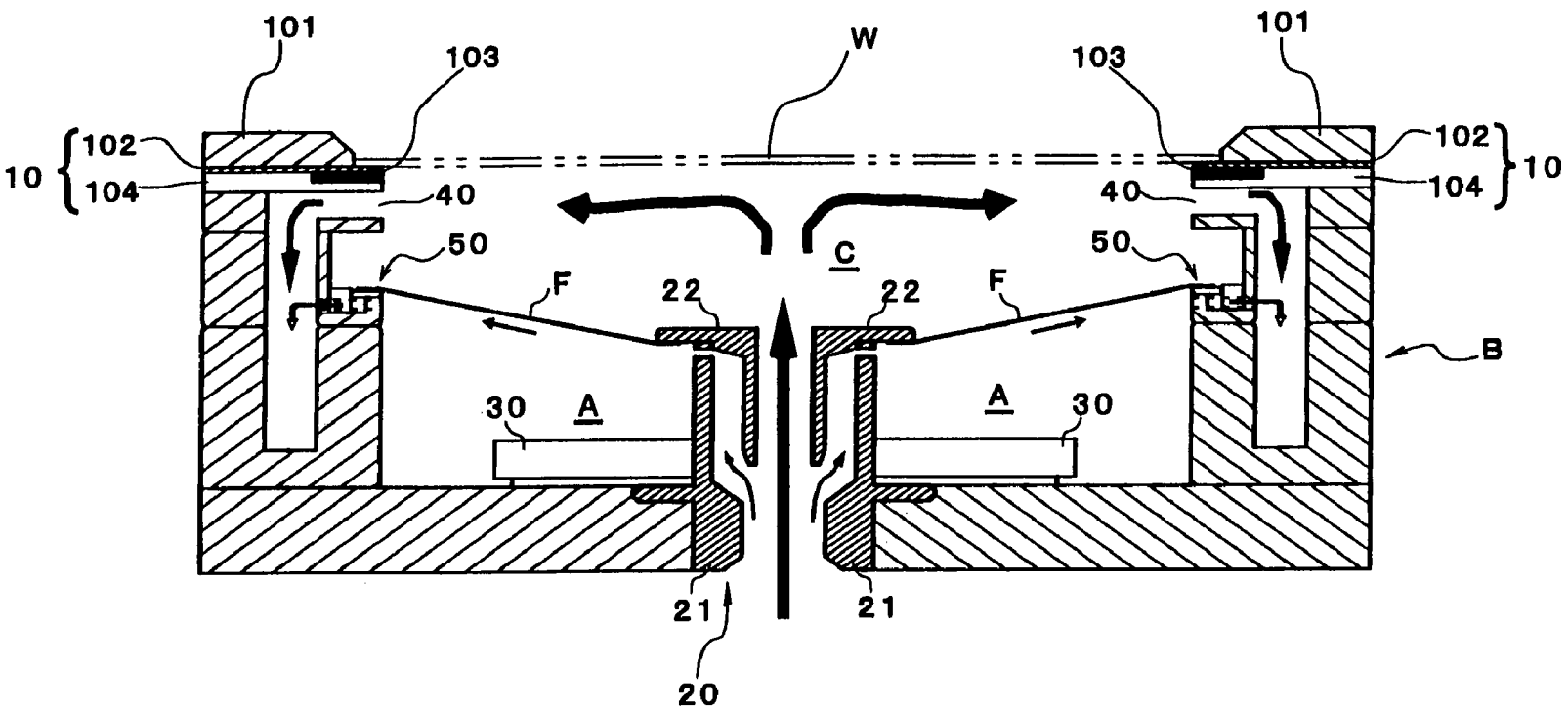
FIG. 1 is a schematic sectional view showing a plating apparatus according to First Embodiment.

A schematic cross-sectional view of a plating apparatus according to First Embodiment of the present invention is shown in FIG. 1. The plating apparatus shown in FIG. 1 is of a jet-flow type, which is for instance provided with a cup-shaped plating apparatus B having: an opening 10 on which an object to be plated W such as a wafer or the like can be arranged; a solution-supply tube 20 for supplying a plating solution toward the object to be plated W; and an anode electrode 30 positioned in an opposed manner to the object to be plated W. In the plating tank B, there is arranged a diaphragm F in a cone-shaped manner for isolating the object to be plated W from the anode electrode 30. The diaphragm F serves to form, in the plating tank B, an anode chamber A; and a cathode chamber C for plating an object to be plated.

The opening 10 of the plating tank B is formed of a top ring 101, an annular cathode electrode 102 coming into contact with a periphery of the object to be plated W, a seal packing 103, and an annual support 104. There is formed beneath the opening 10 in the plating tank B a solution discharge path 40 for a plating solution supplied toward the object to be plated W. The plating solution discharged through the solution discharge path 40 passes through a wall of the plating tank B and is sent to a not-shown plating-solution storage tank.

Figure 2:
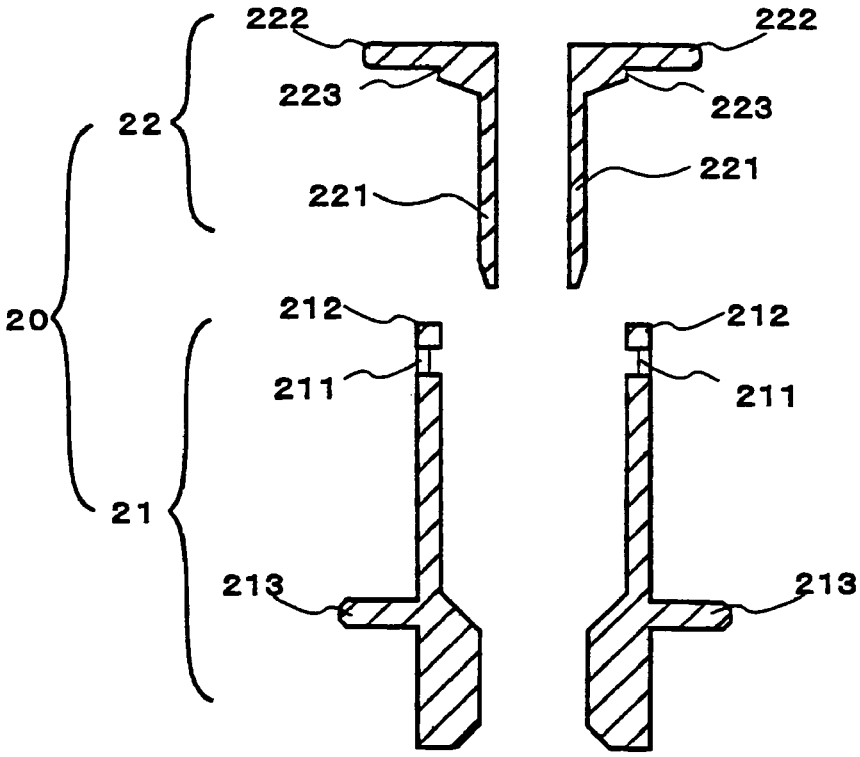
FIG. 2 is an exploded schematic cross-sectional view showing a solution-supply tube according to First Embodiment.

As FIG. 2 shows, the solution-supply tube 20 has a dual tube structure comprising an outer tube 21 and an inner tube 22. The outer tube 21 is provided at an upper end side thereof with an anode-chamber solution supply port 211 for introducing a plating solution to the anode chamber A, and is formed at an upper end thereof with an engaging part 212, which engages with the inner tube 22. A tank-fixing part 213 is provided to allow the outer tube 21 to be fixed to a center of the bottom of the plating tank B. The inner tube 22 is provided with an inner tube part capable of running through a through-hole formed at a center of the diaphragm F, and with a collar 222, for fixing the through-hole of the diaphragm. An under side of the collar 222 is formed with an engaging part 223, which is adapted to engage with the engaging part 212 of the outer tube 21.

Figure 3:
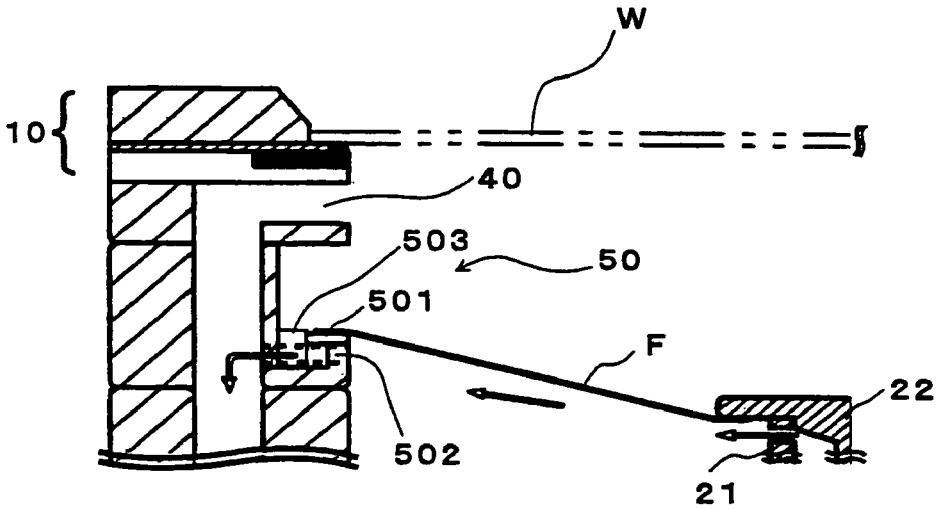
FIG. 3 is a partially enlarged sectional view showing a plating apparatus according to First Embodiment.

As FIG. 1 shows, an inner wall of the plating tank B is provided with a diaphragm-periphery fixing part 50 for fixing a periphery of the diaphragm F. FIG. 3 is an enlarged view, which shows a part of the diaphragm-periphery fixing part 50. The diaphragm-periphery fixing part 50 constitutes a part of the inner wall of the plating tank B, and is provided with a diaphragm attaching part 501 for fixing the periphery of the diaphragm F. Beneath the diaphragm attaching part 501, there is provided an anode-chamber solution discharge port 502 for discharging a plating solution out of the anode chamber A. On the anode-chamber solution discharge port 502, there is arranged a filter 503 for removing impurities present in the plating solution.

Figure 4:
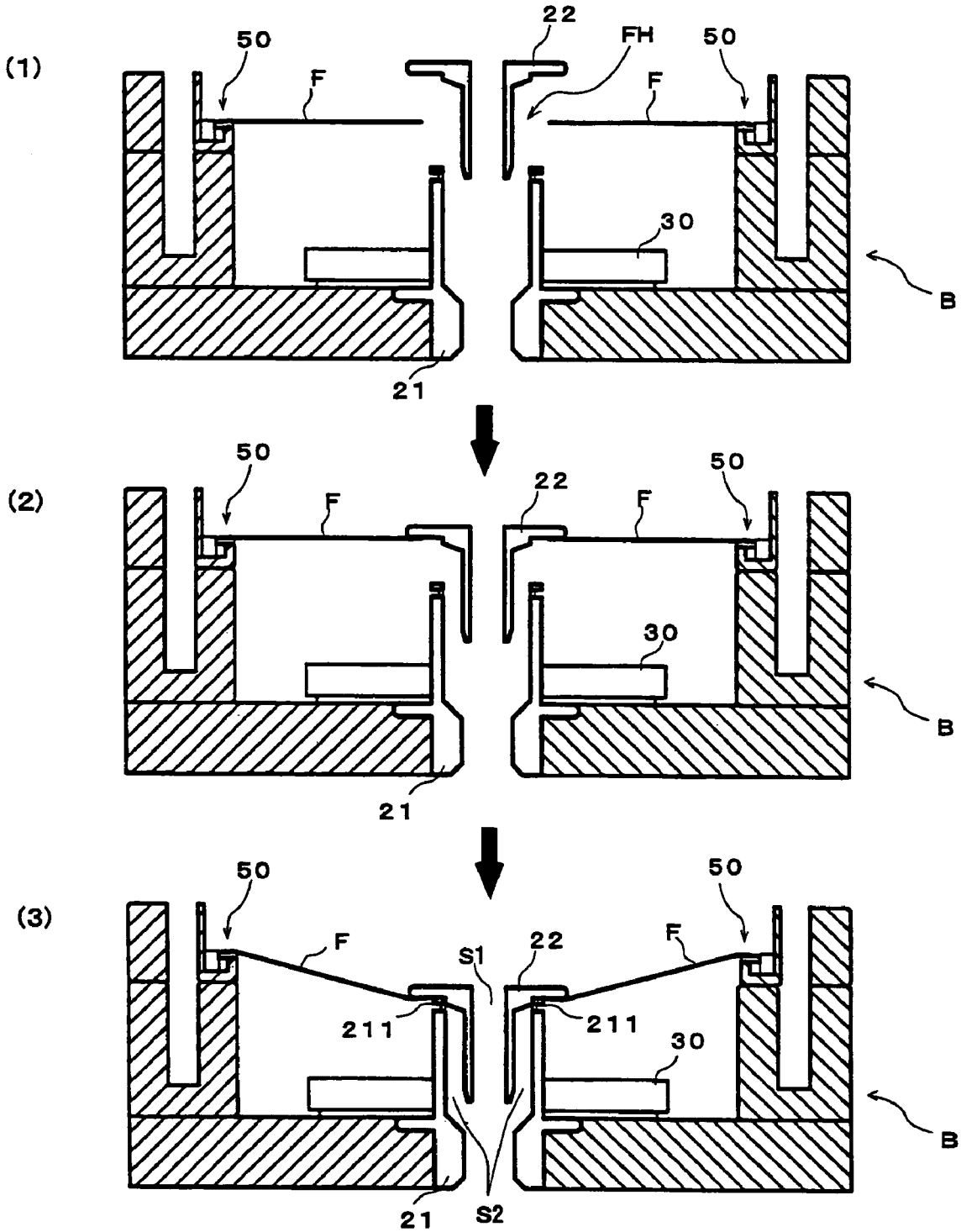
FIG. 4 is a schematic view showing procedures for installing a diaphragm in a plating apparatus according to First Embodiment.

Next, procedures for installing the diaphragm in the plating apparatus of the present embodiment are described. FIG. 4 specifically shows such procedures (1) to (3) for installing the diaphragm. First, at the center of the bottom of the plating tank B, the outer tube 21 is attached and the anode electrode 30 is installed. Then, the diaphragm-periphery fixing part 50, which constitutes a part of the wall of the tank is installed, and the periphery of the diaphragm F is fixed by means of the diaphragm-attaching part 501. See FIG. 4 (1). Next, an inner tube part 221 is introduced through a through-hole FH formed at a center of the diaphragm F until the collar 222 of the inner tube 22 contacts the diaphragm F. See FIG. 4 (2). Further, the inner tube 22 is shifted downward and the inner tube part 221 is inserted slowly into the outer tube 21, the engaging part 223 of the inner tube 22 is allowed to engage with the engaging part 212 formed at the upper end of the outer tube 21, thereby the outer tube 21 is fixed with the inner tube 22 to form the solution-supply tube 20 having a dual tube structure. See FIG. 4 (3). Simultaneously, the through-hole FH of the diaphragm F is also fixed via the collar 222. It should be noted that in this First Embodiment, since a horizontal position where the through-hole FH of the diaphragm F is fixed is set lower than that of the diaphragm-periphery fixing part 50 with which the periphery of the diaphragm F is fixed, the diaphragm F is installed in a cone-shaped manner. In the solution-supply tube 20 having a dual tube structure, when the diaphragm F is fixed, a predetermined space, i.e. a diverging solution flow path, is formed between the inner wall of the outer tube 21 and the outer wall of the inner tube 22. That is to say, the solution-supply tube 20 forms a main plating-solution supply path S1 due to the inner tube and a diverging solution flow path S2 for introducing a plating solution to the solution supply port 211 of the anode chamber A, which port 211 being provided on the upper end side of the outer tube.

After the diaphragm F is positioned in the plating tank B by following the procedures shown in FIG. 4, an annular support 104, a seal packing 103, an annular cathode electrode 102, and a top ring 101 are installed sequentially to form an opening 10 for positioning the object to be plated W.

In the plating apparatus as shown in First Embodiment, a plating treatment is carried out in a manner as follows. First, the diaphragm F is installed in the plating tank B by following the above-described procedures, and a wafer as being an object to be plated is positioned on the opening 10 of the plating tank B. The object to be plated W is depressed onto and fixed to the annular support 104 by means of a not-shown depressing means present above the object to be plated W. The periphery of the object to be plated W contacts the annular cathode electrode 102 installed on the opening 10, thereby plating current is supplied.

After the object to be plated W is positioned, a plating solution is sent to the solution-supply tube 20, the plating solution is supplied toward the object to be plated W through the main plating-solution supply path S1, and some of the plating solution passes the diverging solution flow path S2 of the solution-supply tube 20 and is supplied to the anode chamber A through the solution supply port 211.

A plating solution supplied through the main plating-solution supply path S1 flows to spread from around the center of a surface being plated of the object to be plated W toward periphery of the object to be plated W, and then is discharged out of the discharge path 40. A plating solution supplied to the anode chamber A is discharged out of the anode-chamber solution discharge port 502 provided in the diaphragm-periphery fixing part 50. Impurities present in the plating solution to be discharged out of the anode chamber is removed by means of the filter 503.

In the plating apparatus according to the above-described embodiment, operations during a manufacture of the apparatus, especially an operation where the diaphragm was installed in a cone-shaped manner was carried out extremely easily. Removal of the diaphragm required for operations including replacement of an anode were also carried out easily and a subsequent installation of a diaphragm was also carried out easily, so that efficiency in a maintenance work improved spectacularly.

Second Embodiment

Figure 5:
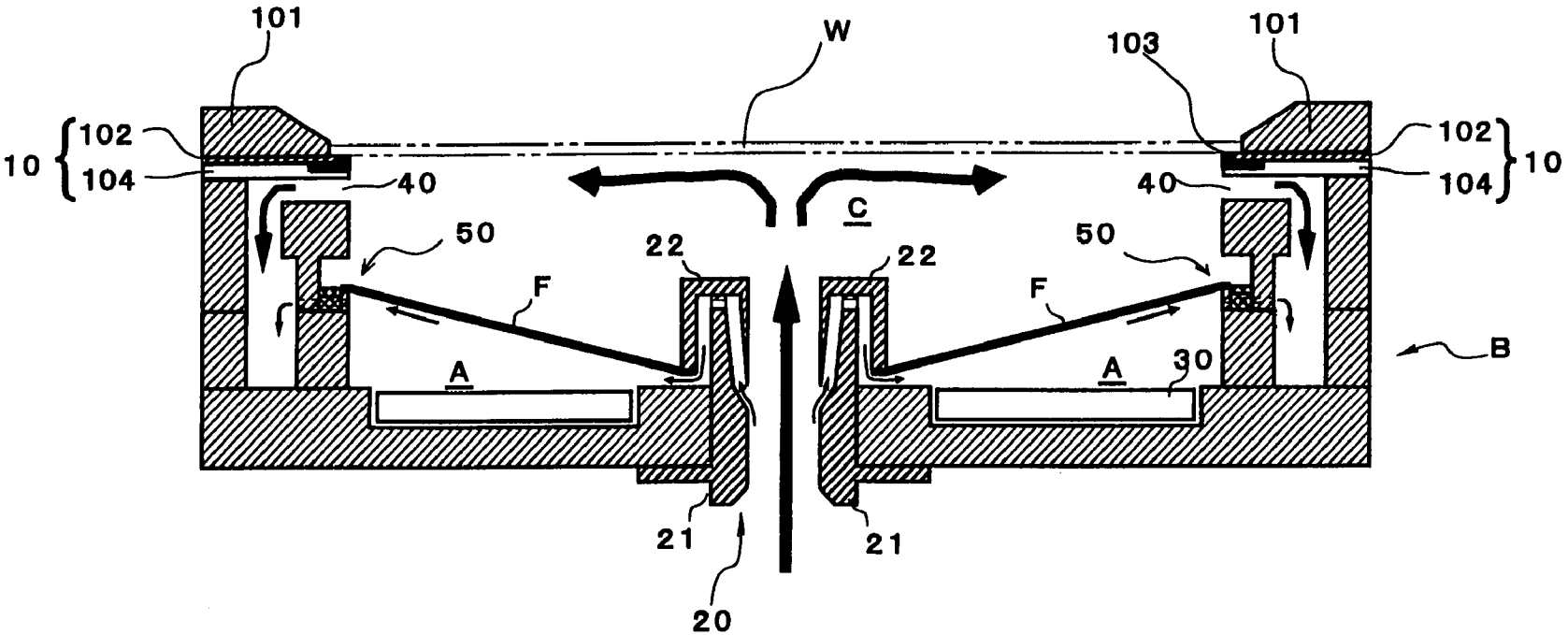
FIG. 5 is a schematic sectional view showing a plating apparatus according to Second Embodiment.

In Second Embodiment, description is being made with respect to a plating apparatus having a different solution-supply tube in structure from the counterpart in present First Embodiment. FIG. 5 is a schematic sectional view, which illustrates a plating apparatus according to Second Embodiment of the present invention. The plating apparatus according to Second Embodiment is also of a jet-flow type, similarly to the counterpart according to First Embodiment, and conducts a plating treatment with an object to be plated W such as a wafer installed. In that sense, identical numerical references are repeatedly used with respect to an apparatus having an identical structure to the counterpart according to First Embodiment in FIGS. 1 through 4. Incidentally, since procedures for installing a diaphragm and for plating treatment are basically the same as those in First Embodiment, detailed description thereof is omitted.

Figure 6:
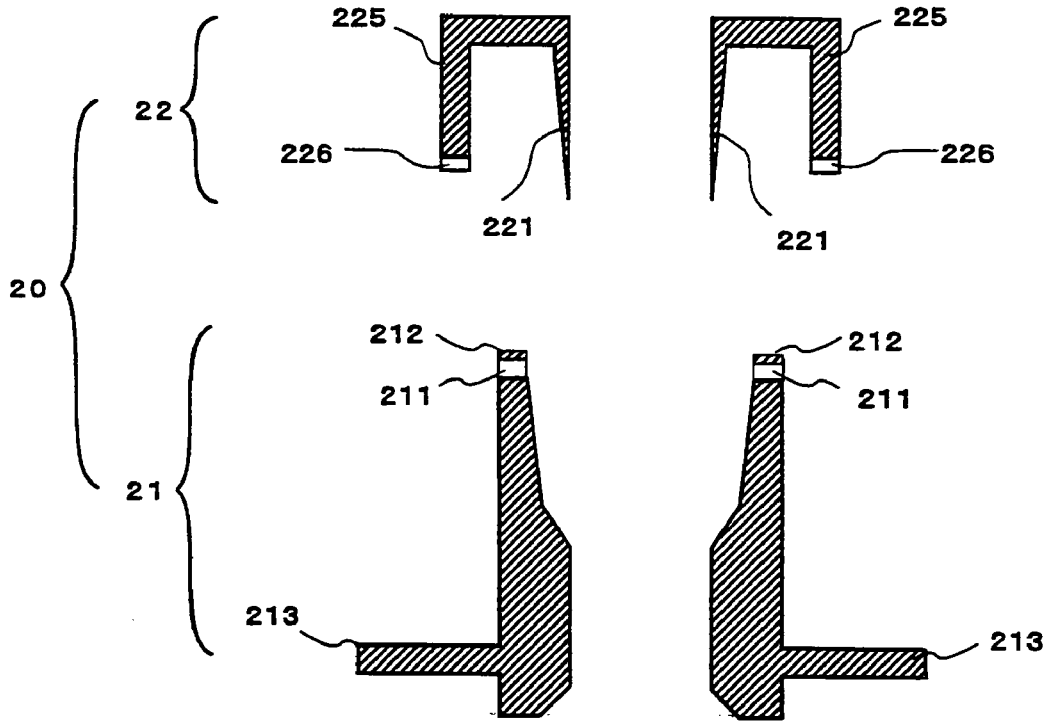
FIG. 6 is an exploded schematic cross-sectional view showing a solution-supply tube according to Second Embodiment.

The plating apparatus according to Second Embodiment and shown in FIG. 5 has a solution-supply tube 20 with an inner tube 22 having a completely different structure from the counterpart according to First Embodiment. FIG. 6 is an exploded cross-sectional view, which illustrates the solution-supply tube 20 according to Second Embodiment. As will be understood from FIG. 6, an outer tube 21 has a similar structure to that according to First Embodiment. The inner tube 22 comprises an inner tube part 221 and a cap part 225, and at a tip side of the cap part 225, there is formed a diaphragm through-hole fixing part 226. The solution-supply tube 20 in the plating apparatus according to Second Embodiment is installed in a manner that the inner tube part 221 and the cap part 225 of the inner tube 22 cover the circumference of the outer tube 21.

Figure 7:
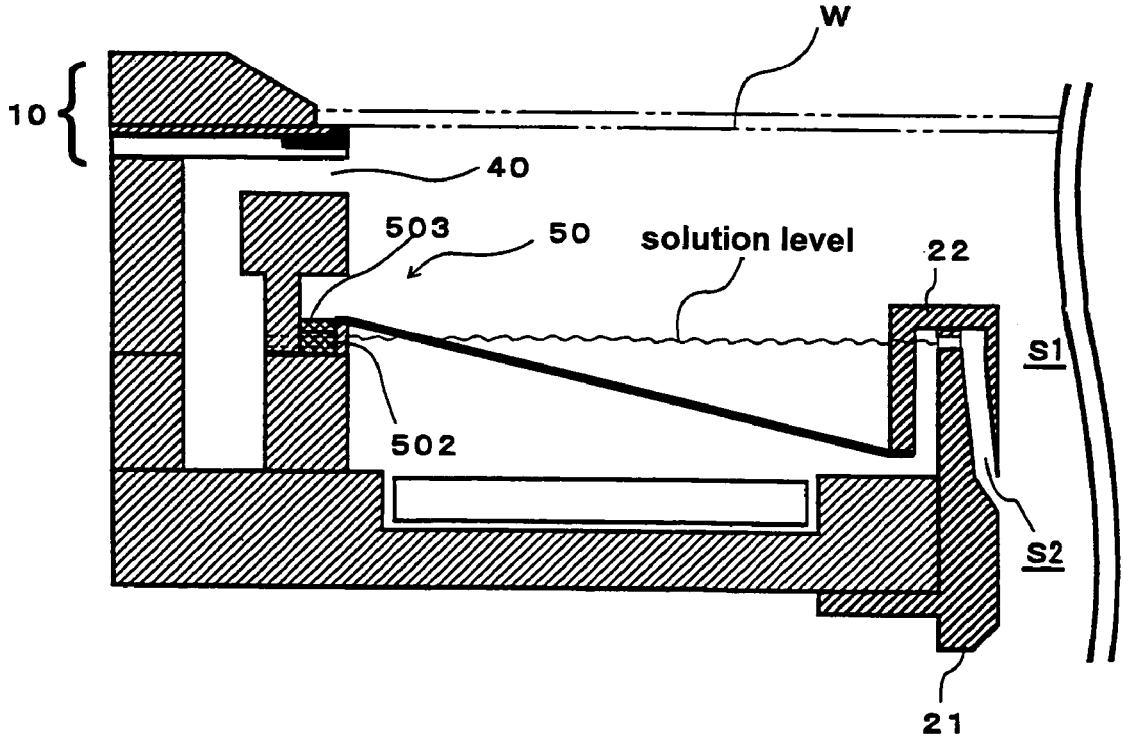
FIG. 7 is a partially enlarged sectional view showing a plating apparatus according to Second Embodiment.

FIG. 7 is a partially enlarged sectional view, which illustrates the plating apparatus as shown in FIG. 5. When the solution-supply tube 20 as shown in FIG. 6 is installed, a predetermined space, i.e. a diverging solution flow path S2, is formed between the outer tube 21 and the inner tube 22, which is installed covering the circumference of the outer tube 21, as shown in FIG. 7. That is to say, in the solution-supply tube 20 according to Second Embodiment, a plating solution flowing through the diverging solution flow path S2 passes the anode-chamber solution supply port 211 of the outer tube 21 and moves along the shape of the cap part 225 of the inner tube 22, and is eventually supplied to the anode chamber A. The plating solution supplied to the anode chamber A is discharged out of the anode-chamber solution discharge port 502 provided below the diaphragm-periphery fixing part 50.

In the plating apparatus according to Second Embodiment, the anode-chamber solution supply port 211 formed in the outer tube 21 of the solution-supply tube 20 is provided at a position slightly higher than a horizontal position of the anode-chamber solution discharge port 502 provided below the diaphragm-periphery fixing part 50. Consequently, in the plating apparatus according to Second Embodiment, even when a plating solution has been discharged out of the plating tank for the purpose of replacing an object to be plated W, a plating solution can be stored within the plating tank so that a condition where the diaphragm F can be maintained immersed in the plating solution, as seen from a wavy line, i.e. solution level in FIG. 7. Therefore, every time a maintenance work is carried out for, for instance, replacing an object to be plated W, the diaphragm F can be prohibited from contacting atmospheric air. Further, since the anode chamber A has been filled with a plating solution, a plating solution can be supplied smoothly into the plating tank for initiating next plating treatment.

Figure 8:
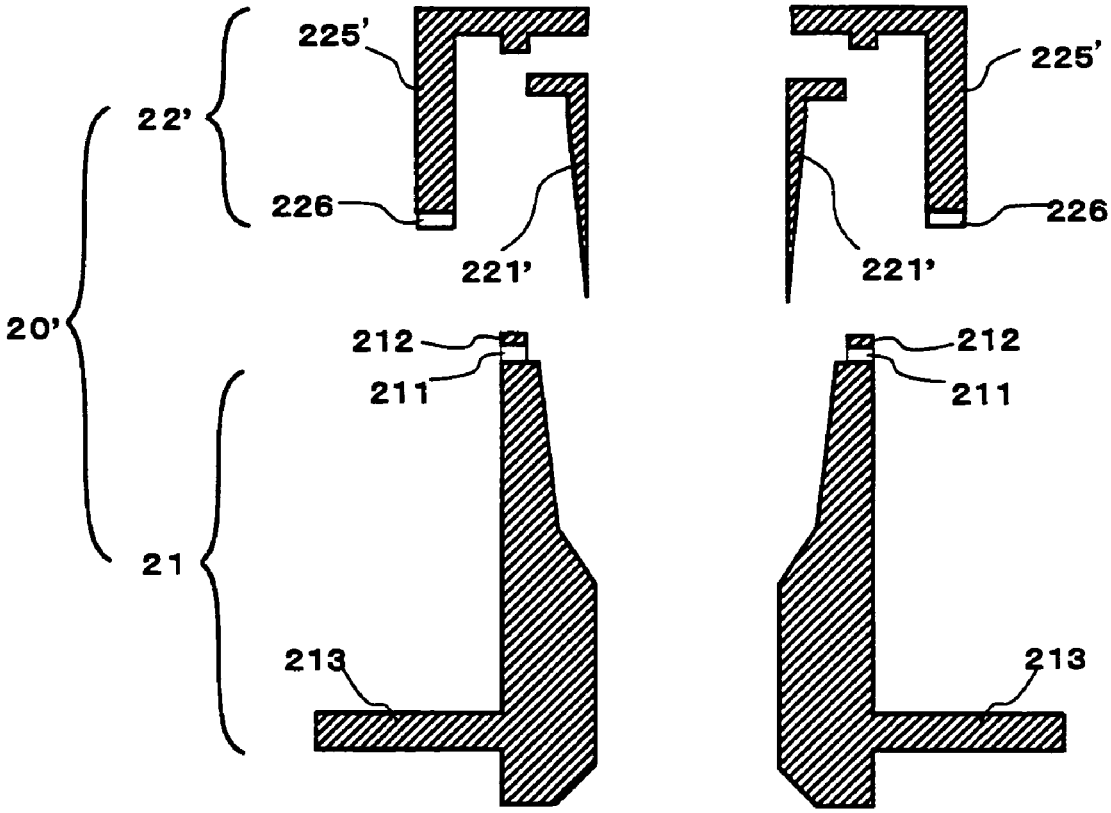
FIG. 8 is an exploded schematic sectional view showing a solution supply tube of another embodiment.

Further, description is made with reference to FIG. 8 in regard to a solution supply tube of another embodiment, which is different from the counterpart according to Second Embodiment as shown in FIG. 6. FIG. 8 is an exploded schematic sectional view, which shows a solution supply tube of another embodiment. The solution supply tube 20' shown in FIG. 8 consists of an inner tube 22' and an outer tube 21, and a configuration of the inner tube 22' is different from the counterpart in structure shown in FIG. 6 according to Second Embodiment. The inner tube 22' in FIG. 8 comprises an inner tube part 221' and a cap part 225', and the inner tube part 221' and the cap part 225' are formed in a separated manner. The outer tube 21 has a basically similar structure to that of the counterpart shown in FIG. 6 according to Second Embodiment, and an engaging part 212 provided at an upper end of the outer tube 21 is engaged with the cap part 225'. The inner tube part 221' is mounted in a manner that, when the cap part 225' has been mounted to the outer tube 21, one end side of the inner tube part 221' is vertically movable between the upper end of the outer tube 21 and the cap part 225' so as to close or open the anode-chamber solution supply port 211 provided at the upper end of the outer tube 21.

Figure 9:
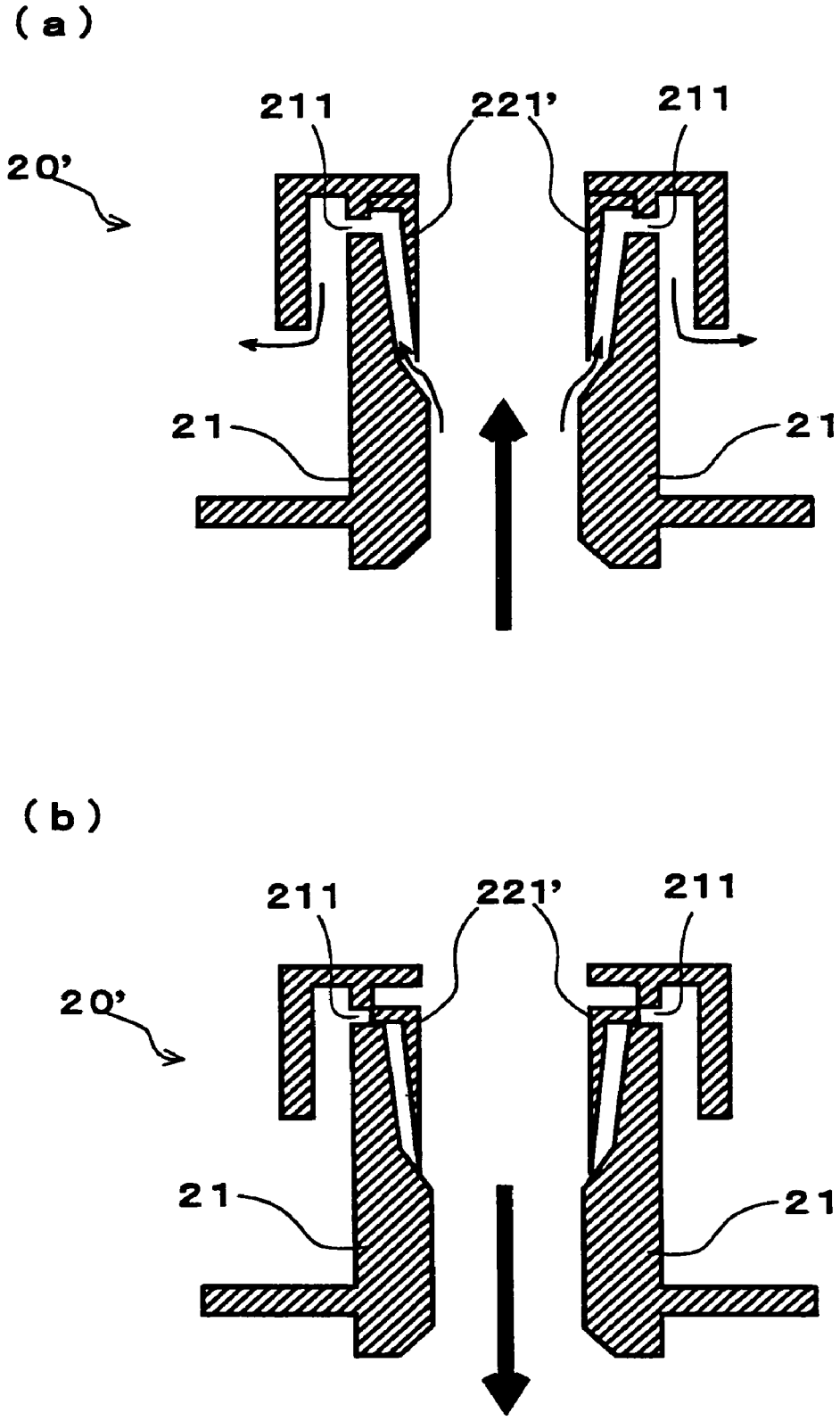
FIG. 9 is a sectional view for explaining the solution supply tube shown in FIG. 8.

Since the solution supply tube 20' shown in FIG. 8 has a vertically movable inner tube part 221', an operation as shown in FIG. 9 can be performed. FIG. 9(*a*) illustrates a state where a plating solution is supplied into a plating tank with the use of the solution supply tube shown in FIG. 8, and FIG. 9(*b*) illustrates a state where a plating solution is discharged out of a plating tank. As FIG. 9(*a*) shows, when a plating solution is supplied, the inner tube part 221' is boosted upward due to a pressure of a plating solution supplied upward to keep the anode-chamber solution supply port 211 open, thereby the plating solution passes the diverging solution flow path and moves along the shape of the cap part 225', and will be eventually supplied to the anode chamber A. In contrast, when a plating solution is discharged out of a plating tank, the inner tube part 221' is depressed downward due to a pressure of a plating solution discharged downward to keep the anode-chamber solution supply port 211 closed. Thus, when the anode-chamber solution supply port 211 is closed, the plating solution existing on the anode chamber side fills the anode chamber, thereby maintaining for sure a state where a diaphragm immersed in a plating solution as FIG. 7 shows.

Third Embodiment

Figure 10:
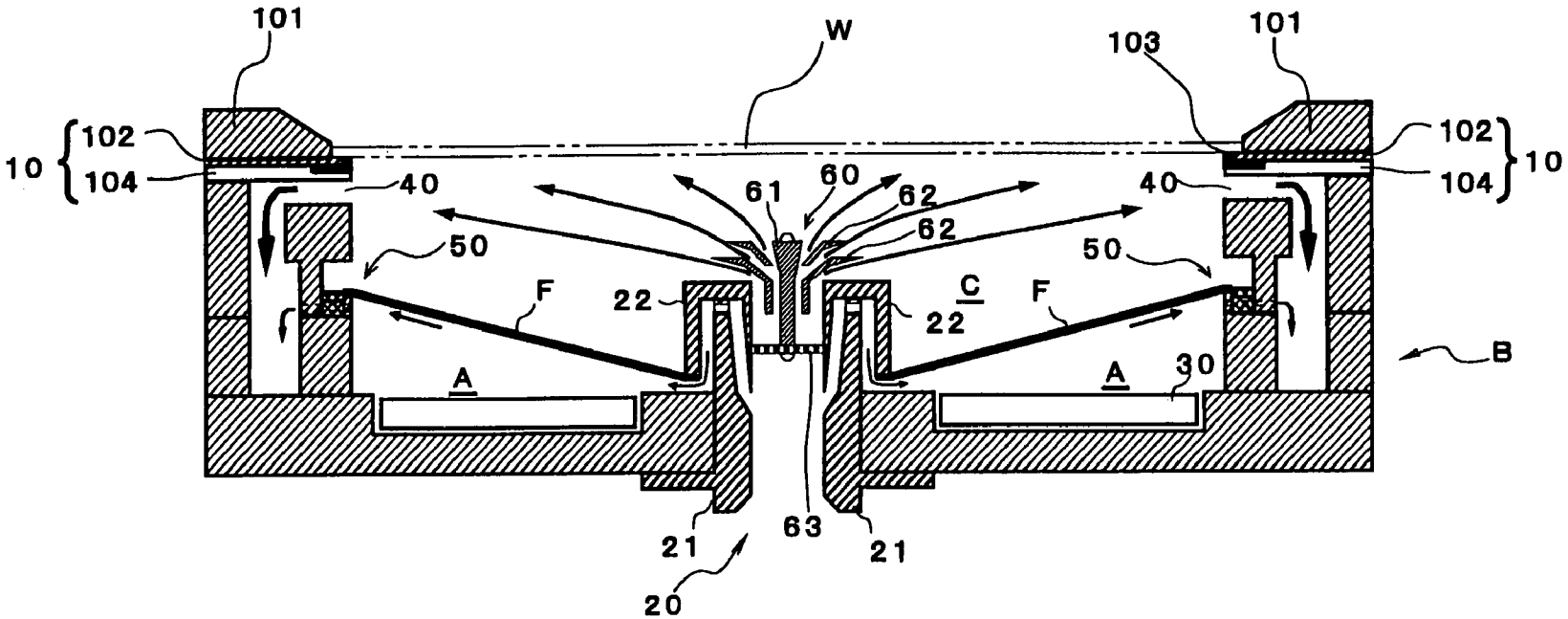
FIG. 10 is a schematic sectional view showing a plating apparatus according to Third Embodiment.

In Third Embodiment, description is being made with respect to a plating apparatus of a structure having a solution flow diverting means provided in the inner tube of the solution supply tube according to Second Embodiment. FIG. 10 is a schematic sectional view, which illustrates a plating apparatus according to Third Embodiment of the present invention. The plating apparatus according to Third Embodiment is also of a jet-flow type, similarly to the counterpart according to Second Embodiment, and conducts a plating treatment with an object to be plated W such as a wafer installed. In that sense, identical numerical references are repeatedly used with respect to an apparatus having an identical structure to the counterpart according to Second Embodiment shown in FIG. 5. Incidentally, since procedures for installing a diaphragm and for plating treatment are basically the same as those in First and Second Embodiments, detailed description thereof is omitted.

In the plating apparatus according to Third Embodiment, a solution flow diverting means 60 is provided in an inner tube 22 of a solution supply tube 20. The solution flow diverting means 60 is of a structure, which comprises a strut 61, and two funnel-shaped diversion plates having different size from each other disposed concentrically on the strut 61. The solution flow diverting means 60 is fixed through mounting the strut 61 onto a meshed stationary plate 63. Due to the solution flow diverting means 60, a plating solution supplied from the solution supply tube passes through the meshed stationary plate 63, advances along a solution flow diverting path formed with the two funnel-shaped diversion plates 62 having different size from each other, and will be supplied into a plating tank. Consequently, as indicated by bold line arrows in FIG. 10, the plating solution will spread radially and flow within the plating tank. Further, owing to the presence of the strut 61, the plating solution will be inhibited from being supplied in a concentrated manner to or around a wafer W.

Next, description is made with respect to a result of investigation conducted on advantage of the solution flow diverting means of Third Embodiment. The investigation of advantage of the solution flow diverting means was conducted by employing a Sn—Ag alloy plating solution, carrying out a Sn—Ag alloy plating with a targeted thickness of 7 μm on a wafer having a size of 300 mm in diameter, and measuring the thickness. A diameter of the inner tube was 30 mm, and the solution flow diverting path formed with the funnel-shaped diversion plates was about 1 mm in width. An electrolyte membrane was adopted as the diaphragm, and an insoluble electrode was adopted as the anode electrode. As the Sn—Ag alloy plating solution, a commercially available plating solution having a Sn concentration of 50 g/L and a Ag concentration of 0.5 g/L was employed, and a plating treatment was carried out under the conditions of: liquid temperature of 20° C.; a current density of 2.5 A/dm$^2$; and a flow volume of the plating solution from the solution supply tube being 20 L/min.

In the measurements, both the plating apparatus according to Third Embodiment shown in FIG. 10 (Example 1) and a plating apparatus not provided with the solution flow diverting means in the inner tube of the solution supply tube shown in FIG. 10 (Comparative Example 1) were employed to conduct an Sn—Ag alloy plating treatment on respective wafers. The thickness of the Sn—Ag alloy plating was measured in terms of 13 points on the plating surface of each plated wafer. The results are indicated in Table 1.

TABLE 1

| | Average value (μm) | Maximal value (μm) | Minimum value (μm) | Standard deviation | Uniformity (%) |
|---|---|---|---|---|---|
| Example 1 | 7.69 | 8.08 | 7.32 | 0.24 | 4.9 |
| Comparative Example 1 | 7.45 | 8.45 | 6.85 | 0.48 | 10.7 |

(Uniformity = (Maximal value − Minimum value)/(2 × Average value) × 100)

As Table 1 indicates, it was confirmed that a plating treatment by use of the plating apparatus provided with the solution flow diverting means of Example 1 has fewer fluctuation in plating thickness than the counterpart not provided with the solution flow diverting means (Comparative Example 1). With respect to uniformity value indicating a degree of evenness in thickness, Example 1 shows values less than half of in terms of Comparative Example 1, which proved high uniformity in plating thickness.

What is claimed is:

1. A plating apparatus having a plating tank, which plating tank comprising: an opening on which an object to be plated is placed; a solution-supply tube for supplying a plating solution toward the object to be plated; an anode positioned opposed to the object to be plated; and a diaphragm for isolating the object to be plated from the anode, wherein an inner wall of the plating tank is provided with a diaphragm-periphery fixing part for fixing a peripheral end of the diaphragm, the solution-supply tube is composed of a dual tube consisting of an inner tube and an outer tube, the inner tube has an inner tube part allowed to pass through a through-hole formed at a center of the diaphragm and a diaphragm through-hole fixing part for fixing the through-hole, and the outer tube has an engaging part for fixing the inner tube with the inner tube part accommodated and further has a tank-fixing part to be fixed in the plating tank, and wherein when said inner tube has been fixed to said outer tube, there is formed a diverging solution flow path between the inner wall of the outer tube and the outer wall of the inner tube, for supplying a plating solution to the anode chamber which is formed by separating from the object to be plated by use of the diaphragm.

2. The plating apparatus according to claim 1, wherein said diaphragm is arranged in a cone-shaped manner in the plating tank.

3. The plating apparatus according to claim 2, wherein beneath said diaphragm-periphery fixing part, an anode-chamber solution discharge port is provided for discharging a plating solution out of the anode chamber, and the anode-chamber solution discharge port is provided with a filter for removing impurities present in the plating solution.

4. The plating apparatus according to claim 3, wherein said inner tube is provided with a solution flow diverting means for diverting a plating solution to be supplied toward an object to be plated.

5. The plating apparatus according to claim 2, wherein said inner tube is provided with a solution flow diverting means for diverting a plating solution to be supplied toward an object to be plated.

6. The plating apparatus according to claim 1, wherein said inner tube has a cap part which covers a periphery of said outer tube, said cap part is provided on a tip thereof with said diaphragm through-hole fixing part, said outer tube is provided on an upper end thereof with an anode-chamber solution supply port for supplying to the anode chamber the plating solution flowing through the diverging solution flow path, and said anode-chamber solution supply port is provided at a position higher than a horizontal position of said anode-chamber solution discharge port and said diaphragm through-hole fixing part is provided at a position lower than the horizontal position of said anode-chamber solution discharge port.

7. The plating apparatus according to claim 6, wherein said inner tube is provided with a solution flow diverting means for diverting a plating solution to be supplied toward an object to be plated.

8. The plating apparatus according to claim 1, wherein said inner tube is provided with a solution flow diverting means for diverting a plating solution to be supplied toward an object to be plated.

9. The plating apparatus according to claim 1, wherein said diaphragm is arranged in a cone-shaped manner in the plating tank.

10. The plating apparatus according to claim 9, wherein beneath said diaphragm-periphery fixing part, an anode-chamber solution discharge port is provided for discharging a plating solution out of the anode chamber, and the anode-chamber solution discharge port is provided with a filter for removing impurities present in the plating solution.

11. The plating apparatus according to claim 10, wherein said inner tube has a cap part which covers a periphery of said outer tube, said cap part is provided on a tip thereof with said diaphragm through-hole fixing part, said outer tube is provided on an upper end thereof with an anode-chamber solution supply port for supplying to the anode chamber the plating solution flowing through the diverging solution flow path, and said anode-chamber solution supply port is provided at a position higher than a horizontal position of said anode-chamber solution discharge port and said diaphragm through-hole fixing part is provided at a position lower than the horizontal position of said anode-chamber solution discharge port.

12. The plating apparatus according to claim 11, wherein said inner tube is provided with a solution flow diverting means for diverting a plating solution to be supplied toward an object to be plated.

13. The plating apparatus according to claim 10, wherein said inner tube is provided with a solution flow diverting means for diverting a plating solution to be supplied toward an object to be plated.

14. The plating apparatus according to claim 9, wherein said inner tube has a cap part which covers a periphery of said outer tube, said cap part is provided on a tip thereof with said diaphragm through-hole fixing part, said outer tube is provided on an upper end thereof with an anode-chamber solution supply port for supplying to the anode chamber the plating solution flowing through the diverging solution flow path, and said anode-chamber solution supply port is provided at a position higher than a horizontal position of said anode-chamber solution discharge port and said diaphragm through-hole fixing part is provided at a position lower than the horizontal position of said anode-chamber solution discharge port.

15. The plating apparatus according to claim 14, wherein said inner tube is provided with a solution flow diverting means for diverting a plating solution to be supplied toward an object to be plated.

16. The plating apparatus according to claim 9, wherein said inner tube is provided with a solution flow diverting means for diverting a plating solution to be supplied toward an object to be plated.

17. The plating apparatus according to claim 1, wherein said inner tube has a cap part which covers a periphery of said outer tube, said cap part is provided on a tip thereof with said diaphragm through-hole fixing part, said outer tube is provided on an upper end thereof with an anode-chamber solution supply port for supplying to the anode chamber the plating solution flowing through the diverging solution flow path, and said anode-chamber solution supply port is provided at a position higher than a horizontal position of said anode-chamber solution discharge port and said diaphragm through-hole fixing part is provided at a position lower than the horizontal position of said anode-chamber solution discharge port.

18. The plating apparatus according to claim 17, wherein said inner tube is provided with a solution flow diverting means for diverting a plating solution to be supplied toward an object to be plated.

19. The plating apparatus according to claim 1, wherein said inner tube is provided with a solution flow diverting means for diverting a plating solution to be supplied toward an object to be plated.

* * * * *